US006970140B2

(12) United States Patent
Hibino et al.

(10) Patent No.: US 6,970,140 B2
(45) Date of Patent: Nov. 29, 2005

(54) ANTENNA APPARATUS AND PORTABLE APPARATUS USING THE SAME

(75) Inventors: Yasuhiro Hibino, Gifu (JP); Ryuichi Kamimoto, Aichi (JP); Akira Ito, Gifu (JP); Tatsuya Nagatsu, Gifu (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 28 days.

(21) Appl. No.: 10/469,078

(22) PCT Filed: Dec. 24, 2002

(86) PCT No.: PCT/JP02/13435

§ 371 (c)(1),
(2), (4) Date: Aug. 26, 2003

(87) PCT Pub. No.: WO03/061068

PCT Pub. Date: Jul. 24, 2003

(65) Prior Publication Data

US 2004/0080466 A1 Apr. 29, 2004

(30) Foreign Application Priority Data

Jan. 10, 2002 (JP) ..... 2002-003083
May 28, 2002 (JP) ..... 2002-153400

(51) Int. Cl.[7] ..... H01Q 1/50
(52) U.S. Cl. ..... 343/860; 343/702
(58) Field of Search ..... 343/702, 860, 343/862, 713; 333/32, 17.3

(56) References Cited

U.S. PATENT DOCUMENTS

| | | | | |
|---|---|---|---|---|
| 5,089,829 | A * | 2/1992 | Haruyama et al. | 343/852 |
| 5,602,558 | A * | 2/1997 | Urakami et al. | 343/850 |
| 5,654,721 | A * | 8/1997 | Saitou et al. | 343/713 |
| 5,874,926 | A * | 2/1999 | Tsuru et al. | 343/860 |
| 5,907,308 | A * | 5/1999 | Oka et al. | 343/713 |
| 6,072,435 | A * | 6/2000 | Terashima et al. | 343/713 |

FOREIGN PATENT DOCUMENTS

| | | | |
|---|---|---|---|
| JP | 59-097232 | A | 6/1984 |
| JP | 62-213303 | A | 9/1987 |
| JP | 09-074304 | A | 3/1997 |
| JP | 09-098011 | A | 4/1997 |
| JP | 10-098405 | A | 4/1998 |
| JP | 2001-298379 | A | 10/2001 |

OTHER PUBLICATIONS

Japanese International Search Report for PCT/JP02/13435, dated Apr. 8, 2003.
English translation of Form PCT/ISA/210.
T. Yoshida, "Action Series for Field Engineers—6, High Frequency Circuit Design Know-How", CQ Publishing Co., Ltd., p. 165, Jul 20, 1985.

* cited by examiner

*Primary Examiner*—Tan Ho
(74) *Attorney, Agent, or Firm*—RatnerPrestia

(57) ABSTRACT

An antenna device comprises an antenna element formed in a sufficiently shorter length as compared with the wavelength of transmission or reception wave, a resistor, a matching circuit including at least a reactance element, and an output terminal connected to outside, which are connected in series in this sequence. As a result, an antenna device of smaller size and small loss is obtained.

25 Claims, 5 Drawing Sheets

ANTENNA APPARATUS AND PORTABLE APPARATUS USING THE SAME

THIS APPLICATION IS A U.S. NATIONAL PHASE APPLICATION OF PCT INTERNATIONAL APPLICATION PCT/JP02/13435.

TECHNICAL FIELD

The present invention relates to an antenna device using an antenna element sufficiently shorter as compared with the wavelength of transmission wave or reception wave, and a portable apparatus using the same.

BACKGROUND ART

Concerning a conventional antenna device, an example of reception antenna device is explained below by referring to FIG. 7 and FIG. 8.

FIG. 7 is a block diagram of a conventional antenna device. The conventional antenna device comprises, as shown in FIG. 7, an antenna element 101 having a length of about a quarter wavelength of reception wave, a matching circuit 102 connected to this antenna element 101 and formed of a reactance element, and an output terminal 103 connected to the output of this matching circuit 102.

In such conventional structure, however, if an antenna element 101 of a sufficiently small length as compared with the wavelength is used in order to realize a small-sized antenna device, the resistance component of the output impedance of the antenna element 101 is about 0 ohm. It was hence very difficult to match it by using the matching circuit 102 composed of reactance.

This problem is explained together with the Smith chart in FIG. 8. On the Smith chart, as shown in FIG. 8, impedance value 104 at 90 MHz and impedance value 105 at 108 MHz of the antenna element 101 sufficiently small as compared with wavelength are far from target impedance 106 of the output terminal 103, that is, 75 ohms. It is hence necessary to bring the impedance value 104 and impedance value 105 closer to the target impedance 106 of 75 ohms of the output terminal 103 by means of the reactance element of the matching circuit 102.

At this time, to move a long distance from the outer circumference of the Smith chart to the center, the reactance value of the matching circuit 102 is increased. Assuming an inductor as reactance element, however, when the inductance of the inductor is increased, reactance value 107 at 90 MHz and reactance value 108 at 108 MHz are largely different from each other, and the distance between the two is considerably longer than the initial distance between the impedance value 104 at 90 MHz and impedance value 105 at 108 MHz. That is, the impedance variation due to reception frequency increases.

To avoid such problems, hitherto, the antenna element 101 was defined at quarter wavelength of reception wave. Thus, matching with the matching circuit 102 is easy, but the size is increased. For example, at 100 MHz, the wavelength is 3 m, or at 1 GHz, it is 30 cm.

DISCLOSURE OF THE INVENTION

The antenna device of the invention is an antenna device comprising an antenna element formed in a shorter length as compared with the wavelength of transmission or reception wave, a resistor, a matching circuit including at least a reactance element, and an output terminal connected to the matching circuit.

A portable apparatus using the antenna device comprises an antenna element formed in a shorter length as compared with the wavelength of transmission or reception wave, a resistor, a matching circuit including at least a reactance element, an output terminal connected to the matching circuit, a channel selector to which the output of the output terminal is connected, a demodulator to which the output of the channel selector is connected, an error correction unit to which the output of the demodulator is connected, and a data output terminal to which the output of the error correction unit is connected.

DETAILED DESCRIPTION OF PREFERRED EMBODIMENTS

Preferred embodiments of the invention are described below by referring to FIG. 1 to FIG. 6.

(Embodiment 1)

Figure 1:
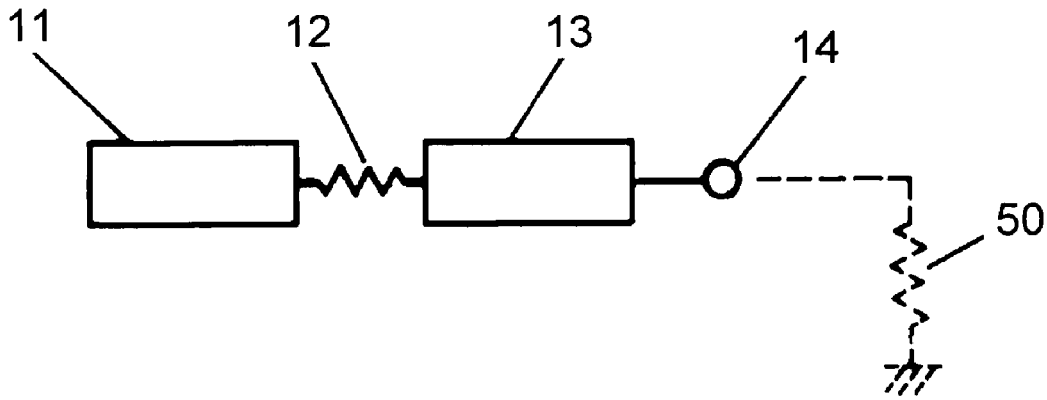
FIG. 1 is a block diagram of antenna device in embodiment 1.

FIG. 1 is a block diagram of antenna device in embodiment 1 of the invention. In FIG. 1, antenna element 11 is a monopole antenna element of 40 mm in length. This is an example of reception of L band frequency of 90 MHz to 108 MHz in VHF band. Actually, since the wavelength is 3 m at 100 MHz, even in the case of quarter wavelength, a monopole antenna element of 75 cm in length is required. The invention is intended to receive by using the monopole antenna element 11 of 40 mm in length.

The antenna element 11 is not limited to the monopole antenna, but dipole antenna, sleeve antenna, collinear antenna, slot antenna, microstrip antenna or others can be similarly used.

Resistor 12 is a resistor connected to the monopole antenna element 11, and a resistance of 82 ohms is used in embodiment 1. As the resistor 12, favorable results were obtained by using any resistance value somewhere between 30 ohms and 500 ohms.

Matching circuit 13 is a matching circuit formed of reactance elements, and its output is connected to an output terminal 14.

Figure 2:
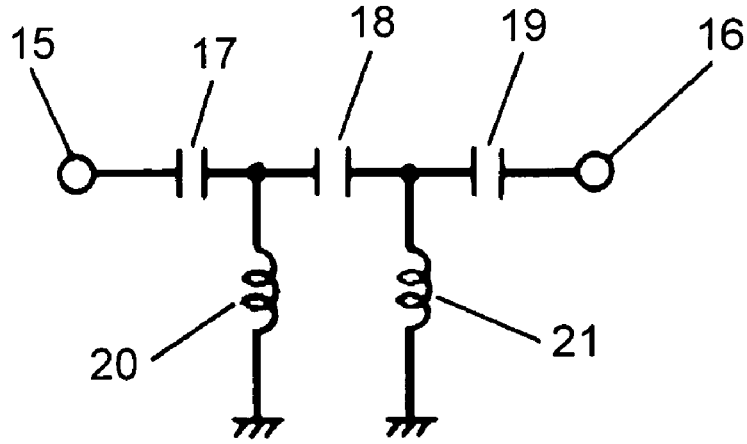
FIG. 2 is a circuit diagram of matching circuit in FIG. 1.

FIG. 2 is a circuit diagram of matching circuit 13. In FIG. 2, terminal 15 is a terminal connected to the resistor 12, and terminal 16 is a terminal connected to the output terminal 14. Between the terminal 15 and terminal 16, chip capacitor 17 of 33 pF, chip capacitor 18 of 6 pF, and chip capacitor 19 of 12 pF are connected in this sequence. Chip inductor 20 of 0.47 pH is connected between the junction of the chip capacitors 17 and 18 and the ground. Chip inductor 21 of 0.39 pH is connected between the junction of the chip capacitors 18 and 19 and the ground.

By using such matching circuit 13, at the reception frequency of 90 MHz to 108 MHz, an antenna device of output impedance of output terminal 14 of about 75 ohms is obtained.

Figure 3:
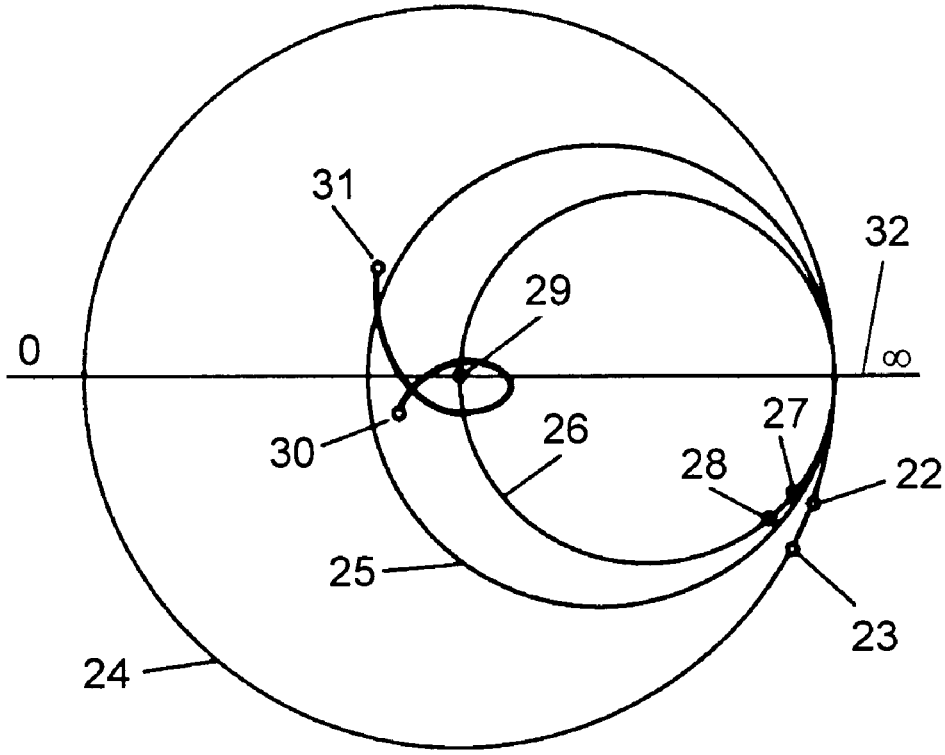
FIG. 3 is a Smith chart of antenna device in FIG. 1.

This is further explained by referring to the Smith chart in FIG. 3. That is, as shown in FIG. 3, impedance value 22 of antenna element 11 at 90 MHz and impedance value 23 of antenna element 11 at 108 MHz are shifted from circuit 24 to 25 or 26 on the Smith chart by inserting resistor 12. At this time, the distance between impedance value 27 of antenna element 11 at 90 MHz and impedance value 28 of antenna element 11 at 108 MHz hardly different from the initial distance between impedance value 22 at 90 MHz and impedance value 23 at 108 MHz. Further, by connecting the resistor 12 in series, the impedance is adjusted so that the characteristic can be located on circle 26 of the Smith chart. Thus, the impedance can be easily brought closer to the target impedance 29. At this time, the distance between impedance value 30 at 90 MHz and impedance value 31 at 108 MHz is very short as shown in FIG. 3.

To achieve the specified function of the matching circuit 13 ideally, the imaginary part of impedance of the matching circuit 13 must be the same absolute value as the imaginary part of the combined impedance of the antenna element 11 and resistor 12 and in reverse polarity, and the real part of impedance of the matching circuit 13 must be equal to the real part of combined impedance of the antenna element 11 and resistor 12. That is, it is important that the impedance value at 90 MHz and impedance value at 108 MHz of the matching circuit 13 must be in symmetrical relation with impedance value 27 at 90 MHz and impedance value 28 at 108 MHz of antenna element 11 on both sides of axis 32. In this configuration, the matching circuit 13 can achieve the specified function ideally. Therefore, the resistance value of the matching circuit 13 as seen from the terminal 15 side should be nearly same as the combined resistance value of the antenna element 11 and resistor 12. However, since the antenna element 11 is sufficiently short as compared with the wavelength, the real part of its impedance is as small as ignorable as compared with the resistance value of the resistor 12. Considering such background, in this embodiment, a winding type chip inductor is used so that the resistance value of chip inductor 20 and resistance value of resistor 12 become to be close to each other between 90 MHz and 108 MHz.

In FIG. 1, load 50 is 75 ohms. As mentioned above, since the impedance of the output terminal 14 for delivering reception waves from 90 MHz to 108 MHz can be also set to about 75 ohms, reflection does not take place at the load 50, and nearly maximum power can be supplied to the load 50. At this time, the resistor 12 is inserted, but the current in the antenna element 11 is hardly changed, and hence the electric power is not decreased substantially as compared with the antenna device without resistance.

Herein, by using a material having resistance of about 82 ohms as the monopole antenna element 11, the resistor 12 is not needed, which contributes to downsizing.

The resistor 12 can be insert at any position between the terminal 15 and terminal 16 of the matching circuit 13.

Further, by using a circuit capable of varying the direct-current resistance value as the resistor 12, and controlling this direct-current resistance value from outside, matching between the antenna element 11 and a receiver connected to the output terminal 14 can be varied, so that the reception signal level can be changed. Therefore, even in a strong field intensity, the input circuit of the receiver is not distorted.

As this variable circuit, resistance characteristic of diode (pin attenuator) can be utilized. Or, connecting a plurality of resistors in series, the both ends of each resistor can be short-circuited electronically by a diode. Alternatively, by parallel connection of a plurality of resistors connected in series with a diode, the resistors are electronically released and short-circuited by the diode.

In embodiment 1, further, the resistance values are brought closer to each other by one chip inductor 20, but two or more chip inductors can be connected in parallel or in series. In the embodiment, a winding type chip inductor is used, but laminated type chip inductor, pattern inductor, air core coil or others can be similarly used. That is, depending on the number of elements for composing the inductor 20 or circuit configuration, only the resistance value of the matching circuit 13 can be properly varied without changing the inductance value, and hence it can be easily applied to various forms of antenna.

(Embodiment 2)

Figure 4:
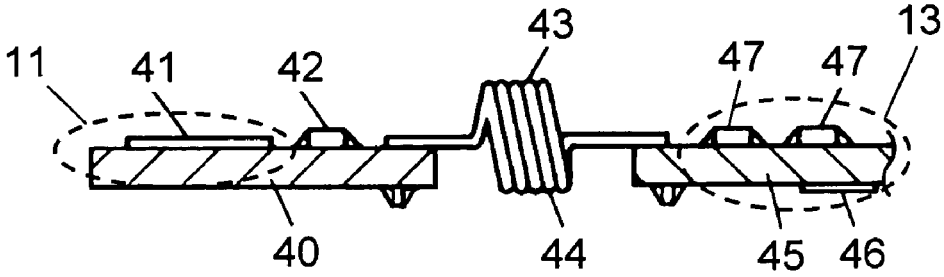
FIG. 4 is an essential sectional view of antenna device in embodiment 2.

Embodiment 2 is explained by referring to FIG. 4.

FIG. 4 is an essential sectional view of embodiment 2. In FIG. 4, same parts as in embodiment 1 are identified with same reference numerals and the explanation is simplified.

In FIG. 4, an antenna element 11 is composed of a printed circuit board 40, and a conductor antenna 41 formed on this printed circuit board 40. The length of the conductor antenna 41 is sufficiently shorter as compared with the wavelength of the reception wave, and the conductor antenna 41 can be formed by an inexpensive method such as etching.

Chip resistor 42 is a chip resistor connected to the conductor antenna 41 and mounted on the printed circuit board 40, and this chip resistor 42 functions same as the resistor 12 in embodiment 1. Preferably, this chip resistor 42 should be connected by reflow soldering. By reflow soldering, a self-alignment effect occurs in the chip resistor 42, and the chip resistor 42 is mounted precisely at specified position. As a result, the inductance of the conductor antenna 41 is not deviated due to deviation in mounting of the chip resistor 42, so that a stable antenna device can be obtained.

In embodiment 2, the chip resistor 42 is mounted on the printed circuit board 40, but the chip resistor 42 can be omitted by using a conductor having a resistance value in the conductor antenna 41 itself.

Movable conductor 43 is electrically connected to the chip resistor 42. The movable conductor 43 is formed of a metal conductor 44 in a coil form. By this movable conductor 43, the antenna element 11 can be directed to a desired direction, so that a favorable reception state can be maintained. Besides, since the movable conductor 43 is formed like a coil, it can be used as part of the matching circuit 13 by making use of its inductance. By using a metal conductor 44 having a resistance value as the movable conductor 43, the chip resistor 42 can be omitted.

Printed circuit board 45 is connected to the movable conductor 43, and the matching circuit 13 is formed on this printed circuit board 45. As a result, the antenna element 11 and chip resistor 42 are connected in series to the matching circuit 13 by way of the movable conductor 43. This matching circuit 13 is formed of pattern inductance 46 and chip capacitor 47 formed in pattern on the printed circuit board 45. By incorporating a chip resistor in the matching circuit 13, the chip resistor 42 can be omitted, and mounting parts at the side of the printed circuit board 40 can be eliminated, so that an inexpensive antenna device can be obtained.

In this configuration, since the antenna device is sufficiently shorter as compared with the wavelength of transmission or reception wave, so that an antenna device reduced in size is realized.

Since the chip resistor 42 is connected in series, the output impedance can be easily set to the target impedance by the matching circuit 13 composed of reactance element, and an antenna device of low loss is realized.

Further, since the chip resistor 42 is used as the resistor 12, a stable resistance value is obtained, and a stable antenna device is realized.

Using the chip resistor, it can be easily mounted by a mounting machine and soldered, so that an inexpensive antenna device can be realized.

(Embodiment 3)

Figure 5:
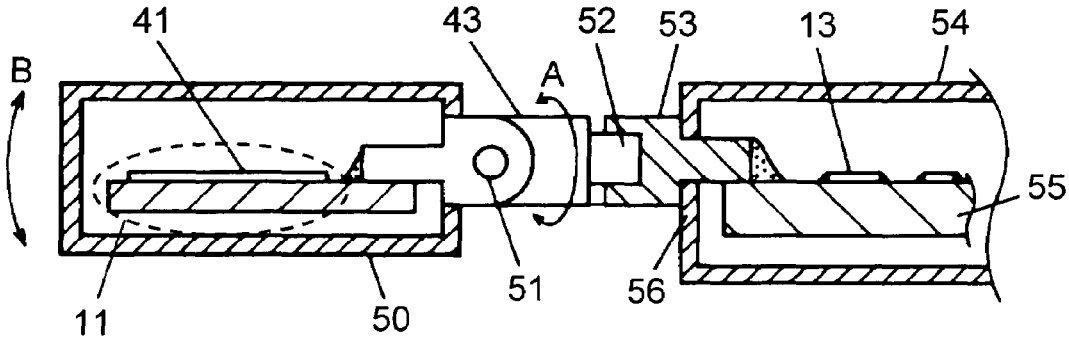
FIG. 5 is an essential sectional view of portable apparatus in embodiment 3.

Embodiment 3 is explained by referring to FIG. 5. FIG. 5 is an essential sectional view of portable apparatus in embodiment 3. In FIG. 5, same parts as in embodiments 1 and 2 are identified with same reference numerals and the explanation is simplified.

In FIG. 5, an antenna case 50 covers an antenna element 11 composed of a conductor antenna 41.

Movable conductor 43 is formed of a metal so as to transfer reception signals, and composed of a first movable conductor 51 provided rotatably in the direction of arrow B, and a second movable conductor 52 provided rotatably in the direction of arrow A. The first movable conductor 51 and second movable conductor 52 electrically contact with each other. Base part 53 is connected to the second movable conductor 52, and is connected to the matching circuit 13 formed on a printed circuit board 55 provided in a portable apparatus 54, and is fixed to a case 56 of the portable apparatus 54.

In this configuration, since the first movable conductor 51, second movable conductor 52, and base part 53 are electrically connected by contacting with each other, a slight contact resistance is present between these movable conductors. Owing to this resistance value, the output impedance can be easily set to a target impedance by the matching circuit 13 composed of reactance element, so that a portable apparatus of small loss is realized.

Since the antenna element 11 is sufficiently shorter as compared with the wavelength of transmission or reception wave, a portable apparatus reduced in size is realized.

In embodiment 3, the resistor 12 having a slight resistance value is the resistance value of the movable conductor 43 itself, but a chip resistor can be used instead. In this case, a resistance value always stable in spite of moving in the antenna direction is obtained, and a portable apparatus capable of receiving stably regardless of antenna direction is realized. When this chip resistor is mounted on the printed circuit board 55 same as in the matching circuit 13, the chip resistor can be mounted simultaneously with the matching circuit 13, and a portable apparatus of high productivity and low price can be realized. To the contrary, when mounted at the antenna element side, it is easier to match at the portable apparatus side.

(Embodiment 4)

Figure 6:
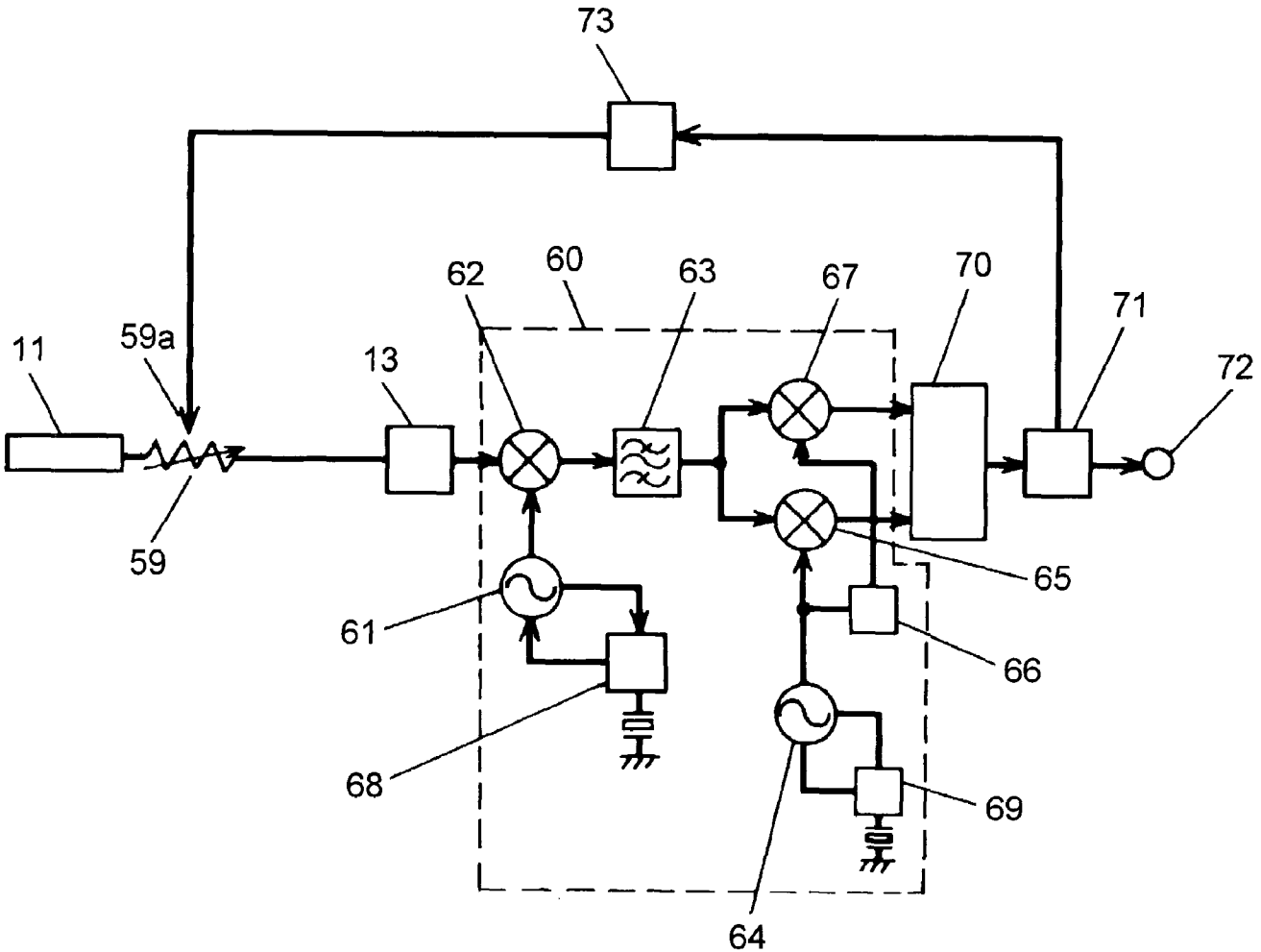
FIG. 6 is a block diagram of portable apparatus in embodiment 4.
Figure 7:
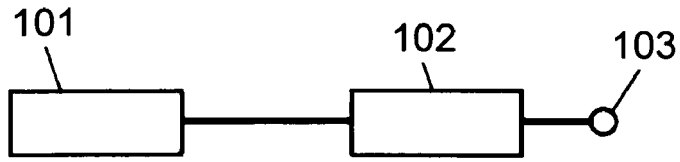
FIG. 7 PRIOR ART
FIG. 7 is a block diagram of conventional antenna device.
Figure 8:
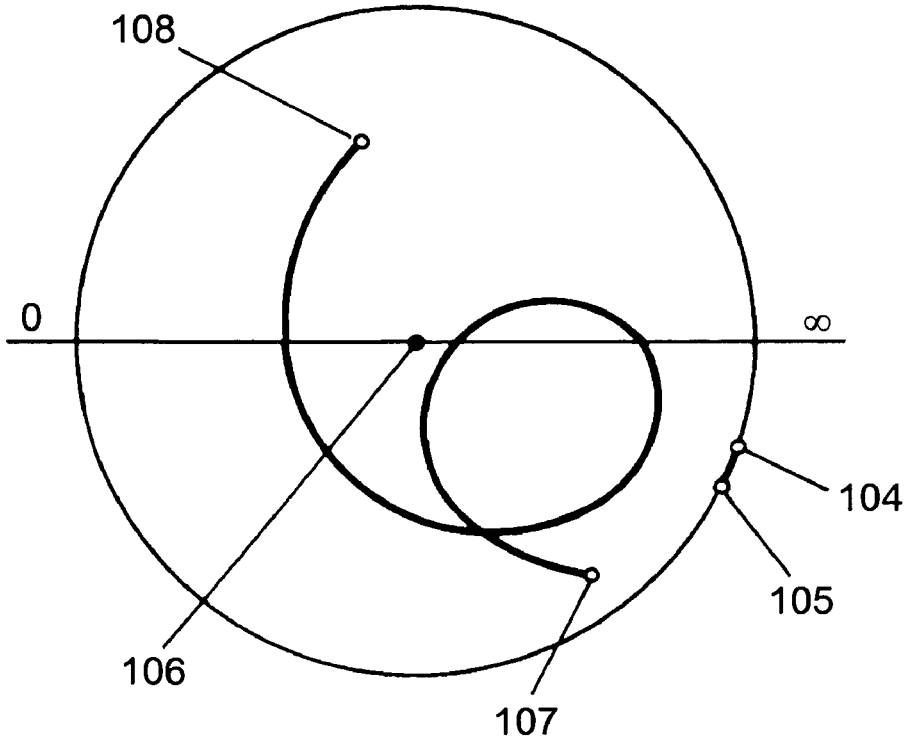
FIG. 8 PRIOR ART
FIG. 8 is a Smith chart of antenna device in FIG. 7.

Embodiment 4 is explained by referring to FIG. 6. FIG. 6 is a block diagram of portable apparatus in embodiment 4. In FIG. 6, same parts as in embodiments 1 to 3 are identified with same reference numerals and the explanation is simplified.

In FIG. 6, a variable resistor 59 is provided between an antenna element 11 and a matching circuit 13. The variable resistor 59 is controlled from outside by way of a control terminal 59*a* provided in the variable resistor 59, and the resistance value is changed. By changing the resistance value, the reception signal level of the reception signal can be varied, and it is possible to control for an optimum reception level.

Channel selector 60 is connected to the matching circuit 13, and selects a signal of desired reception frequency of the waves received by the antenna element 11.

This channel selector 60 comprises a mixer 62 receiving an output from the matching circuit 13 at one input and receiving an output from a local oscillator 61 at other input, a surface acoustic wave (SAW) filter 63 for receiving an output from this mixer 62, a mixer 65 receiving an output from the SAW filter 63 at one input and receiving an output from a local oscillator 64 at other input, and a mixer 67 receiving an output from the SAW filter 63 at one input and receiving an output from the local oscillator 64 at other input by way of a phase shifter 66. The local oscillators 61 and 64 are composed of loop connection of PLL circuits 68, 69, respectively.

The mixer 62 mixes an oscillation signal of the local oscillator 61 and an output signal from the matching circuit 13, and converts the output signal of the matching circuit 13 into an intermediate frequency signal of about two times of its maximum frequency (about 900 MHz). In embodiment 4, the frequency of this intermediate frequency signal is 1.9 GHz. Therefore, it is less likely to be disturbed by secondary harmonic distortion or tertiary harmonic distortion of television broadcast signals.

The output of the mixer 62 is connected to the SAW filter 63. This SAW filter 63 has a very steep attenuation characteristic, with a pass band of 6 MHz as the television broadcast signal band centered on the frequency of the intermediate frequency signal, and is capable of passing only signals of required frequency properly. Therefore, undesired interference can be eliminated securely.

Further, in embodiment 4, since the intermediate frequency is a very high frequency at 1.9 GHz, the SAW filter 63 can be reduced in size, and the high frequency signal receiving apparatus can be reduced in size.

An output of the SAW filter 63 is supplied to one terminal of the mixer 65 and one terminal of the mixer 67, and a signal delivered from the local oscillator 64 is supplied to other terminal of the mixer 65 and other terminal of the mixer 67. A phase shifter 66 is inserted between the mixer 67 and local oscillator 64, and a signal shifted in phase by 90° from the output signal of the local oscillator 64 is supplied to the mixer 67. As a result, I signal and Q signal are extracted. By mixing the signals in the mixers 65 and 67, I signal and Q signal are extracted directly, so that a small-sized high frequency receiving apparatus can be presented without requiring extra detector or the like.

In this case, by setting the oscillation frequency of the local oscillator 64 at a frequency nearly equal to the frequency of the intermediate frequency signal, the intermediate frequency signal is detected directly.

Outputs of the mixers 65 and 67 are supplied to a demodulator 70. This demodulator 70 is composed of a demodulator of OFDM demodulation and a register for controlling it. By feeding data into a terminal provided in the register, the modulator 70 is controlled.

An output of the demodulator 70 is put into an error correction unit 71. An output of this error correction unit 71 is connected to a data output terminal 72. Herein, the error correction unit 71 is composed of a Viterbi decoder connected to the output of the demodulator 70, and a Reed-Solomon error decoder to which the output of this Viterbi decoder is connected.

Herein, the Viterbi decoder judges if the I signal and Q signal decoded by the mixers 65 and 67 are violating the predetermined rule or not, and corrects and decodes the signals at violating positions. The Reed-Solomon error decoder corrects and decodes again the errors still remaining in the digital signals decoded by the Viterbi decoder. Generally, necessary redundancy data for realizing error correction in the Reed-Solomon error decoder is transmitted preliminarily together with video signal data or audio data. That is, the video signal data and audio data are transmitted in error correction coded state. The Reed-Solomon error decoder corrects and decodes digital signals by using the video signal data and audio data transmitted together with the redundancy data.

Depending on the difference in error correction system in nations, there may be difference in the number of bits in digital signal or number of bits in redundancy data. Generally, however, as far as the bit error rate of random error is about less than 0.0002 in the output of the Viterbi decoder, it is said that the error rate of output of Reed-Solomon error decoder can be set to nearly 0.

A microcomputer 73 is connected to other output of the error correction unit 71. This microcomputer 73 monitors the error rate after Viterbi decoding. When the bit error rate is, for example, less than 0.002 and it is judged that the error rate is stabilized, the microcomputer 73 sends a control signal to a control terminal 59*a*. That is, when the bit error rate after Viterbi decoding is less than 0.002 and is stable, it means that the broadcast wave is received stable, for example, in a strong field intensity. Therefore, when the microcomputer 73 controls the resistance value of the variable resistor 59 and receives the broadcast wave even in strong field intensity, it operates so as not to distort the signal in the input circuit of the channel selector 60.

To the contrary, if the bit error rate after Viterbi decoding exceeds a specified value, it means that the reception state is not a preferred state. Therefore, the microcomputer 73 controls the resistance value through the control terminal 59*a* of the variable resistor 59 and can function to improve the reception state.

In such configuration, since the antenna elemrnt 11 is sufficiently shorter as compared with the wavelength of transmission or reception wave, and a portable apparatus of reduced size is realized.

Besides, since the resistors are connected in series, the output impedance can be set to the target impedance easily by the matching circuit composed of reactance element, and the loss is decreased, and the error rate can be held in low state.

Therefore, when the high frequency signal being received is digital television broadcast, by maintaining the error rate of reception signal data at low level, block noise of image is less likely to occur, and the broadcast can be received in a clear image.

Further, as the microcomputer 73 controls the resistance value of the variable resistor 59, the reception level varies, and when receiving broadcast wave of strong field intensity district, the signal is not distorted in the input circuit of the channel selector 60, and the improving effect of error rate can be further enhanced.

Hence, block noise of image is less likely to occur due to increase of error rate of reception signal data, and a clear signal can be received.

As shown in the foregoing embodiments 1 to 4, according to the invention, the antenna element formed in a length sufficiently shorter as compared with the wavelength of transmission or reception wave, the resistor, the matching circuit including at least a reactance element, and the output terminal to be connected to outside are connected in series in this sequence, and since the antenna element is sufficiently shorter as compared with the wavelength of transmission or reception wave, an antenna device of reduced size is realized.

Since the resistor is connected in series, the output impedance can be set to the target impedance easily by the matching circuit composed of reactance element, and an antenna device of small loss is realized.

By setting the resistance value of the resistor to a resistance value nearly equal to the impedance of the output terminal, reactance matching in the matching circuit is easy.

Besides, in an antenna device of the invention, the antenna element formed in a length sufficiently shorter as compared with the wavelength of transmission or reception wave, the matching circuit formed of a reactance element, and the output terminal to be connected to this matching circuit are connected in series in this sequence, and the direct-current resistance of the antenna element is set nearly equal to the impedance of the output terminal. In this antenna device, since resistor is not needed as separate member, the size can be further reduced.

In an antenna device of the invention, the movable conductor connected the antenna element and capable of moving this antenna element is provided between the antenna element and the matching circuit. This antenna device can move the antenna depending on the wave state, and set at the optimum reception level.

In an antenna device of the invention, the antenna element formed in a length sufficiently shorter as compared with the wavelength of transmission or reception wave, the matching circuit, and the output terminal to be connected to this matching circuit are connected in series in this sequence, and this matching circuit is composed of the resistor inserted between the input and output of the matching circuit, and the reactance element. In this antenna device, since the antenna element is sufficiently shorter as compared with the wavelength of transmission or reception wave, an antenna device of reduced size is realized.

By inserting the resistor in series between the input and output of the matching circuit, the output impedance can be easily set to the target impedance by the matching circuit, and an antenna device of small loss is realized.

The resistance value of the resistor is set to a resistance value nearly equal to the impedance of the output terminal. As a result, it is easy to match the reactance in the matching circuit.

In an antenna device of the invention, the movable conductor connected to the antenna element and capable of moving the antenna element is provided between the antenna element and the matching circuit. This antenna device can move the antenna depending on the wave state, and set at the optimum reception level.

In an antenna device of the invention, the antenna element formed in a length sufficiently shorter as compared with the wavelength of transmission or reception wave, the variable resistor capable of varying the direct-current resistance, the matching circuit formed of a reactance element, and the terminal connected to this matching circuit are connected in series in this sequence, and the direct-current resistance of the variable resistor is controllable from outside. In this antenna device, since the reception level varies by changing the resistance value from outside, the wave is not distorted in the input circuit of the receiver if receiving broadcast wave in strong electric field intensity district.

In an antenna device of the invention, the antenna element formed in a length sufficiently shorter as compared with the wavelength of transmission or reception wave, the movable conductor connected to this antenna element and capable of moving the antenna element, the matching circuit connected to the movable conductor and formed of a reactance element, and the output terminal connected to this matching circuit are connected in series in this sequence, and the movable conductor is formed of a metal conductor having a small resistance value. This antenna device can move the antenna depending on the wave state, and set at the optimum reception level.

In addition, since the movable conductor has a small resistance value, resistor is not needed as particular member, and the size is further reduced.

The movable conductor of other antenna device has inductance or capacitance. This antenna device includes the inductance or capacitance as part of the matching circuit, that is, the inductance or capacitance of the movable conductor plays the role of the part for composing the matching circuit. Therefore, the number of parts of the matching circuit can be reduced, and a much smaller size is realized.

The movable conductor is a metal coil spring in an antenna device. In this antenna device, the coil spring is used as the inductor, and other inductor member is not needed, so that the size is smaller.

The antenna element of an antenna device has a conductor resistance value. In this antenna device, since the conductor resistance of the antenna element is slight, signal loss does not occur in the antenna element. Therefore, an antenna of an excellent sensitivity is realized.

The antenna element of an antenna device is formed of a copper foil provided on a printed circuit board. In this antenna device, since the antenna element is a copper foil formed on the printed circuit board, the antenna element can be formed by etching or other method. Hence, an antenna device of excellent productivity and low cost is obtained.

Besides, since the antenna element is formed on the printed circuit board, the resistor can be mounted on the printed circuit board on which the antenna element is formed, and an antenna device of excellent productivity is obtained.

In an antenna device of the invention, the resistor is mounted on the printed circuit board and connected by reflow solder. In this antenna device, since the resistor can be mounted on the printed circuit board on which the antenna element is formed, and an antenna device of excellent productivity is obtained.

Still more, since the resistor is mounted on the printed circuit board together with the antenna element, it is easy to match in the matching circuit.

The resistor can be mounted at a high positional precision owing to the self-alignment effect. Therefore, change of inductance value of the antenna element due to deviation of mounting position of the resistor can be decreased, and a stable antenna device can be obtained.

The reactance of an antenna device is formed of a pattern inductor. In this antenna device, since the antenna element can be formed in a method of excellent productivity such as etching, an antenna device of low cost is obtained.

Since the inductance is formed in a pattern, it is easy to adjust by trimming or the like, and a stable antenna device is obtained.

In an antenna device of the invention, the reactance is formed of pattern inductor and chip capacitor, and this chip capacitor is mounted by reflow soldering. In this antenna device, changes of inductance value of the pattern inductor of the matching circuit due to deviation of mounting position can be decreased, and a stable antenna device is obtained.

In an antenna device of the invention, the resistance value of the resistor is nearly equal to the resistance value as seen from the antenna element side of the matching circuit. In this antenna device, since the resistance components of the impedance are nearly equal and are matched, the loss of the signal received from the antenna is small, and the loss of the signal transmitted to the downstream side such as the receiver is smaller.

A portable apparatus of the invention comprises an antenna element formed in a length sufficiently shorter as compared with the wavelength of transmission or reception wave, a resistor connected to this antenna element and having a direct-current resistance value, a matching circuit connected to this resistor and formed of a reactance element, an output terminal connected to this matching circuit, a channel selector to which the output of the output terminal is connected, a demodulator to which the output of the channel selector is connected, an error correction unit to which the output of the demodulator is connected, and a data output terminal to which the output of the error correction unit is connected, in which the resistance value of the resistor is large enough not to have effect on the bit error rate of demodulated signal at the data output terminal. In this portable apparatus, the bit error rate is not worsened, and missing of data or image is less likely to occur.

By increasing the resistance value, thermal noise is increased by this resistor, and loss of reception signal occurs, and the level of the signal to be put into the channel selector becomes smaller. As a result, the S/N ratio of the signal is worsened, and the bit error rate becomes worse. Accordingly, by increasing the resistance value of the resistor up to an extent not to have effect on the bit error rate, the impedance can be matched easily, and fluctuations of reactance value in the reception frequency band can be decreased, and mismatching of impedance does not occur in the reception frequency band, so that a small and stable antenna device can be realized.

In a portable apparatus of the invention, the reactance of the matching circuit has a large reactance value to an extent not to have effect on the bit error rate of the demodulation signal at the data output terminal. In this portable apparatus, the bit error rate is not worsened, and missing of data or image is less likely to occur.

That is, when the reactance value is small, fluctuations of impedance in the reception frequency band are smaller, but mismatching of impedance occurs at the reception frequency and signal loss occurs. To the contrary, when the reactance is larger, fluctuations of impedance in the reception frequency band are larger. Herein, since the reactance value is a large reactance value not to have effect on the bit error rate, the bit error rate is not worsened.

A portable apparatus of the invention comprises an antenna element formed in a length sufficiently shorter as compared with the wavelength of transmission or reception wave, and a metal movable conductor connected to this antenna element and capable of moving the antenna element, and the portable apparatus is connected to this movable conductor, and this portable apparatus further comprises a matching circuit connected to the movable conductor and formed of a reactance element, and an output terminal connected to this matching circuit, in which a resistor having a resistance value is inserted between the antenna element and matching circuit. Since the antenna device is sufficiently shorter as compared with the wavelength of transmission or reception wave, a portable apparatus of reduced size is realized.

Besides, since the resistor is inserted, the output impedance can be set to the target impedance easily by the matching circuit composed of the reactance element, and a portable apparatus of small loss can be realized.

A portable apparatus of the invention comprises a printed circuit board on which a matching circuit is formed, and a resistor mounted on this printed circuit board, being inserted between the movable conductor and the matching circuit. In this configuration, since the resistor can be mounted on the circuit board same as the printed circuit board on which the matching circuit is formed, the productivity is excellent, and a portable apparatus of low cost is realized.

A portable apparatus of the invention comprises an antenna element formed in a length sufficiently shorter as compared with the wavelength of transmission or reception wave, and a metal movable conductor connected to this antenna element and capable of moving the antenna element, and the portable apparatus is connected to this movable conductor, and this portable apparatus further comprises a matching circuit connected to the movable conductor and formed of a reactance element, and a terminal connected to this matching circuit, in which the movable conductor has a resistance value. This portable apparatus is capable of moving the antenna depending on the wave state, and can set at an optimum reception level.

Besides, since the movable conductor has a slight resistance value, any extra member for resistor is not needed, and the size is further reduced.

A portable apparatus of the invention comprises an antenna element formed in a length sufficiently shorter as compared with the wavelength of transmission or reception wave, a resistor connected to this antenna element and having a direct-current resistance value, a matching circuit connected to this resistor and formed of a reactance element, an output terminal connected to this matching circuit, a channel selector to which the output of the output terminal is connected, a demodulator to which the output of the channel selector is connected, an error correction unit to which the output of the demodulator is connected, and a data output terminal to which the output of the error correction unit is connected, which further comprises a microcomputer to which the output of the error correction unit is connected, and which controls the resistance value of the resistor on the basis of the error rate issued from the error correction unit. In this portable apparatus, since the antenna element is sufficiently shorter as compared with the wavelength of transmission or reception wave, a portable apparatus of reduced size is realized.

Since the resistor is connected in series, the output impedance can be set to the target impedance easily by the matching circuit composed of reactance element, and the loss can be reduced, so that the error rate is not increased in the reception frequency range. Therefore, when the high frequency signal to be received is digital television broadcast, block noise of image due to increase of error rte of reception signal data hardly occurs, and broadcast of clear image can be received.

Further, the microcomputer controls the resistance value of the resistor, and thereby the impedance varies and the reception level is changed, and hence even when receiving broadcast wave of strong field intensity district, the signal is not distorted in the input circuit of the channel selector, and the improving rate of error rate can be enhanced.

Moreover, block noise of image due to increase of error rate of reception signal data hardly occurs, and a clear signal can be received.

INDUSRIAL APPLICABILITY

The antenna device of the invention comprises an antenna element formed in a shorter length as compared with the wavelength of transmission or reception wave, a resistor, a matching circuit including at least a reactance element, an output terminal connected to this matching circuit, which are connected in series in this sequence. As a result, an antenna device of small size and small loss is obtained. Since the resistor is connected in series, the output impedance can be set to the target impedance easily by the matching circuit composed of reactance element, and an antenna device of small loss is realized. The portable apparatus of the invention uses an antenna element shorter as compared with the wavelength of transmission or reception wave.

What is claimed is:

1. An antenna device comprising:

an antenna element formed in a shorter length as compared with a wavelength of transmission or reception wave;

a resistor;

a matching circuit including at least a reactance element; and an output terminal connected to the matching circuit, wherein the antenna element, the resistor, the matching circuit, and the output terminal are connected in series in this sequence.

2. The antenna device of claim 1, wherein a resistance value of the resistor is a direct-current resistance value nearly equal to the impedance of the output terminal.

3. The antenna device of claim 1, wherein the antenna element has a resistance value.

4. The antenna device of claim 1, wherein the antenna element is formed of a copper foil provided on a printed circuit board.

5. The antenna device of claim 4, wherein the resistor is mounted on a printed circuit board, and is soldered by reflow.

6. The antenna device of claim 1, wherein the reactance element is formed of a pattern inductor.

7. The antenna device of claim 1, wherein the reactance element is formed of a pattern inductor and a chip capacitor, and the chip capacitor is soldered by reflow.

8. The antenna device of claim 1, wherein a resistance value of the resistor and the resistance value as seen from the antenna element side of the matching circuit are nearly equal to each other.

9. An antenna device comprising:

an antenna element formed in a shorter length as compared with a wavelength of transmission or reception wave;

a matching circuit including at least a reactance element; and a terminal connected to the matching circuit, wherein the antenna element, the matching circuit, and the output terminal are connected in series in this sequence, and the direct-current resistance of the antenna element is nearly equal to the impedance of the output terminal.

10. The antenna device of claim 9, further comprising:

a movable conductor inserted between the antenna element and the matching circuit, connected to the antenna element, and capable of moving the antenna element.

11. An antenna device according to claim 9, wherein the direct-current resistance of the antenna element is for matching the reactance in the matching circuit.

12. An antenna device comprising:

an antenna element formed in a shorter length as compared with a wavelength of transmission or reception wave;

a matching circuit; and an output terminal connected to the matching circuit, wherein the antenna element, the matching circuit, and the output terminal are connected in series in this sequence, and the matching circuit is composed of a resistor and a reactance element.

13. The antenna device of claim 12, wherein the resistance value of the resistor is a direct-current resistance value nearly equal to a impedance of the output terminal.

14. The antenna device of claim 12, further comprising:

a movable conductor inserted between the antenna element and the matching circuit, connected to the antenna element, and capable of moving the antenna element.

15. An antenna device according to claim 12, wherein the resistor sets the output impedance to a target impedance.

16. An antenna device comprising:

an antenna element formed in a shorter length as compared with a wavelength of transmission or reception wave;

a variable resistor capable of varying direct-current resistance;

a matching circuit including at least a reactance element; and an output terminal connected to the matching circuit, wherein the antenna element, the variable resistor, the matching circuit, and the output terminal are connected in series in this sequence, and a direct-current resistance value of the variable resistor is controllable.

17. An antenna device comprising:

an antenna element formed in a shorter length as compared with a wavelength of transmission or reception wave;

a movable conductor connected to the antenna element and capable of moving the antenna element;

a matching circuit connected to the movable conductor and including at least a reactance element; and an output terminal connected to the matching circuit, wherein the antenna element, the movable conductor, the matching circuit, and the output terminal are connected in series in this sequence, and the movable conductor is formed of a metal conductor having a resistance value.

18. The antenna device of claim 17, wherein the movable conductor has at least inductance or capacitance.

19. The antenna device of claim 17, wherein the movable conductor is composed of a metal coil spring.

20. A portable apparatus comprising:

an antenna element formed in a shorter length as compared with a wavelength of transmission or reception wave;

a resistor connected to the antenna element and having a direct-current resistance;

a matching circuit connected to the resistor and including at least a reactance element;

an output terminal connected to the matching circuit;

a channel selector to which the output of the output terminal is connected, a demodulator to which the output of the channel selector is connected;

an error correction unit to which an output of the demodulator is connected; and a data output terminal to which an output of the error correction unit is connected, wherein a resistance value of the resistor is increased to such an extent not to have effect on a bit error rate of demodulation signal at the data output terminal.

21. The portable apparatus of claim 20, wherein a reactance of the reactance element is a large reactance value of such an extent not to have effect on the bit error rate of demodulation signal at the data output terminal.

22. A portable apparatus comprising:

an antenna element formed in a shorter length as compared with a wavelength of transmission or reception wave; and a metal movable conductor connected to the antenna element and capable of moving the antenna element, with the portable apparatus connected to the movable conductor, wherein the portable apparatus further comprises:

a matching circuit connected to the movable conductor and including at least a reactance element, and a resistor is inserted between the antenna element and matching circuit.

23. The portable apparatus of claim 22, further comprising:

a printed circuit board on which the matching circuit is formed; and a resistor mounted on this printed circuit board, being inserted between the movable conductor and the matching circuit.

24. A portable apparatus comprising:

an antenna element formed in a shorter length as compared with a wavelength of transmission or reception wave; and a metal movable conductor connected to the antenna element and capable of moving the antenna element, with the portable apparatus connected to the movable conductor, wherein the portable apparatus further comprises a matching circuit connected to the movable conductor and including at least a reactance element, and the movable conductor has a resistance value.

25. A portable apparatus comprising:

an antenna element formed in a shorter length as compared with a wavelength of transmission or reception wave;

a variable resistor connected to the antenna element;

a matching circuit connected to the variable resistor and including at least a reactance element;

an output terminal connected to the matching circuit;

a channel selector to which an output of the output terminal is connected;

a demodulator to which an output of the channel selector is connected;

an error correction unit to which an output of the demodulator is connected;

a data output terminal to which an output of the error correction unit is connected; and a microcomputer to which the output of the error correction unit is connected, for controlling a resistance value of the variable resistor so as to lower the error rate on basis of an error rate issued from the error correction unit.

* * * * *